US010441503B2

(12) United States Patent
French

(10) Patent No.: US 10,441,503 B2
(45) Date of Patent: Oct. 15, 2019

(54) SPA WITH TEMPERATURE RESPONSIVE PUMP ACTIVATION AND DEACTIVATION INDEPENDENT OF HEATER ACTIVATION

(71) Applicant: Richard T. French, Chesterfield, VA (US)

(72) Inventor: Richard T. French, Chesterfield, VA (US)

( * ) Notice: Subject to any disclaimer, the term of this patent is extended or adjusted under 35 U.S.C. 154(b) by 0 days.

(21) Appl. No.: 15/493,423

(22) Filed: Apr. 21, 2017

(65) Prior Publication Data

US 2018/0177680 A1 Jun. 28, 2018

Related U.S. Application Data

(60) Provisional application No. 62/439,316, filed on Dec. 27, 2016.

(51) Int. Cl.
*A47K 3/00* (2006.01)
*A47K 3/10* (2006.01)
*A61H 33/00* (2006.01)

(52) U.S. Cl.
CPC ..... *A61H 33/0087* (2013.01); *A61H 33/0095* (2013.01); *A61H 2033/0037* (2013.01); *A61H 2033/0058* (2013.01)

(58) Field of Classification Search
CPC ..... A61H 33/0087; A61H 33/0095; A61H 2033/0058; A61H 33/027; A47K 3/001; A47K 3/08; E04H 4/129; H01L 21/67248
USPC ..... 4/541.2, 542.2, 541.6, 545, 549, 493
See application file for complete search history.

(56) References Cited

U.S. PATENT DOCUMENTS 3,988,787 A * 11/1976 Colee ..... F16K 11/065 4/489
4,529,033 A * 7/1985 Blum ..... F24H 1/0081 126/374.1
5,245,714 A * 9/1993 Haraga ..... A61H 33/02 134/22.12
6,405,387 B1 * 6/2002 Barnes ..... A61H 33/0087 4/541.1
6,477,723 B1 * 11/2002 Jacuzzi ..... A61H 33/0087 4/541.1
6,754,916 B1 * 6/2004 Cox ..... A61H 33/02 4/541.1
6,875,961 B1 * 4/2005 Collins ..... H05B 1/0283 219/485

(Continued)

*Primary Examiner* — Benjamin R Shaw
(74) *Attorney, Agent, or Firm* — Douglas C. Tsao; Williams Mullen

(57) ABSTRACT

A spa has an insulated cabinet with an uninsulated shell disposed therein. A filter assembly is downstream of a water intake. A heater is downstream of the filter assembly and a pump is downstream of the heater. A diversion line is in fluid line connection with an outlet of the pump. An ozonizor is in fluid communication with the diversion line. The filter assembly is coupled to the diversion line. A data processing system is coupled to the heater, pump, a control panel and a temperature sensor, wherein the data processing system responsive to when the actual temperature of an amount of water in the shell is a magnitude in degrees below a set temperature 1) turns the heater off if it is on or does not turn the heater on if it is already off and 2) turns the pump on if it is off or if it is already running does not turn the pump off.

18 Claims, 5 Drawing Sheets

(56) References Cited

U.S. PATENT DOCUMENTS 6,965,815 B1 * 11/2005 Tompkins ..... G05D 23/1917 4/493
6,976,052 B2 * 12/2005 Tompkins ..... A61H 33/0095 210/167.12
7,875,173 B1 * 1/2011 Barnes ..... A61H 33/14 210/167.1
8,406,932 B2 3/2013 Hollaway
8,973,176 B1 10/2015 Collins
9,775,772 B2 * 10/2017 Tempas ..... A61H 33/028
2001/0002238 A1 * 5/2001 McKain ..... A61H 33/6073 417/280
2002/0000007 A1 * 1/2002 Pittman ..... H05B 3/26 4/545
2004/0244103 A1 * 12/2004 Laflamme ..... A61H 33/60 4/541.1
2005/0005349 A1 * 1/2005 Gardenier ..... A61H 33/60 4/541.1
2006/0288476 A1 * 12/2006 Reynolds, II ..... A61H 33/00 4/541.1
2007/0108185 A1 * 5/2007 Einar ..... A61H 33/0095 219/481
2007/0118983 A1 * 5/2007 Tatum ..... A61H 33/0087 4/541.1
2008/0168599 A1 * 7/2008 Caudill ..... A61H 33/005 4/541.1
2008/0282459 A1 * 11/2008 Cline ..... E04H 4/129 4/493
2010/0064428 A1 * 3/2010 Loyd ..... A61H 33/005 4/541.3
2010/0223721 A1 * 9/2010 May ..... A61H 33/005 4/541.1
2015/0020304 A1 * 1/2015 Rabon ..... E04H 4/08 4/498
2015/0033466 A1 * 2/2015 Ciechanowski ..... A61H 33/005 4/541.2
2015/0366752 A1 * 12/2015 Hatley ..... A61H 33/0087 4/541.3

* cited by examiner

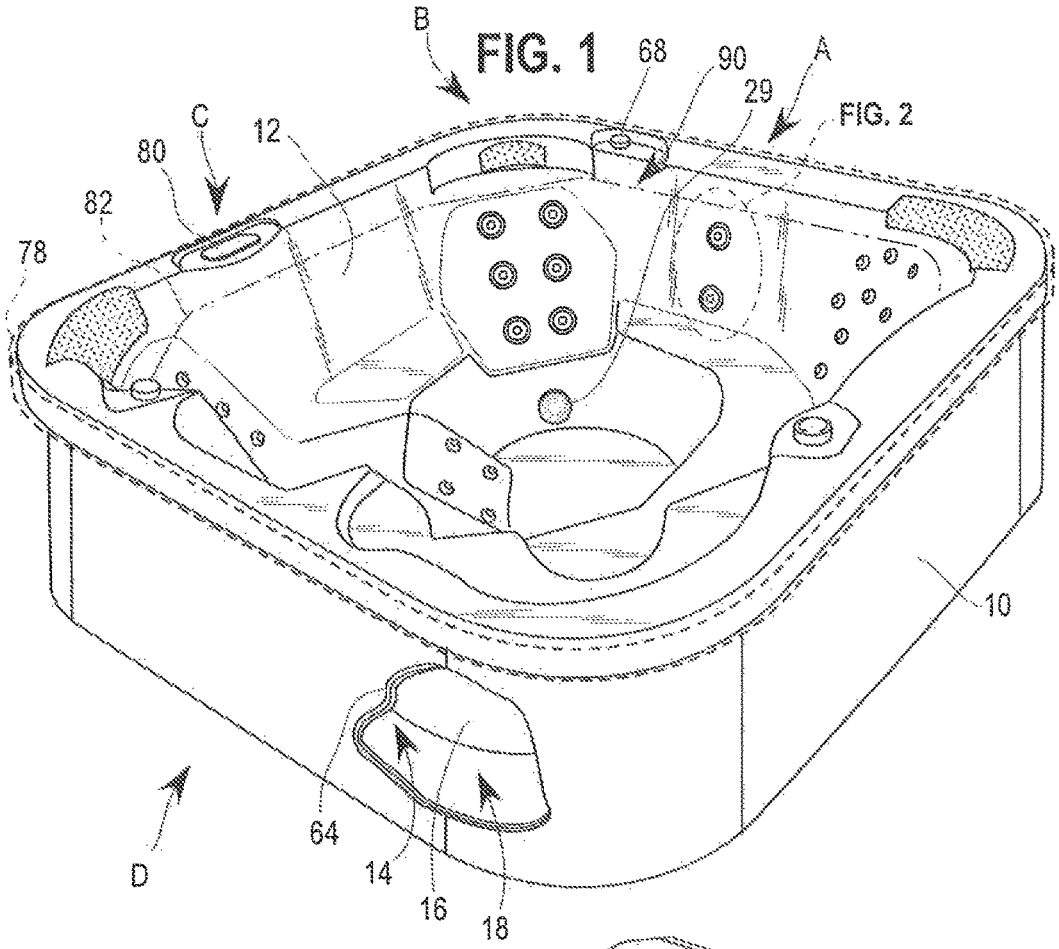
FIG. 1
B
68
90
29
A
FIG. 2
C
12
80
82
78
10
64
14
16
18
D
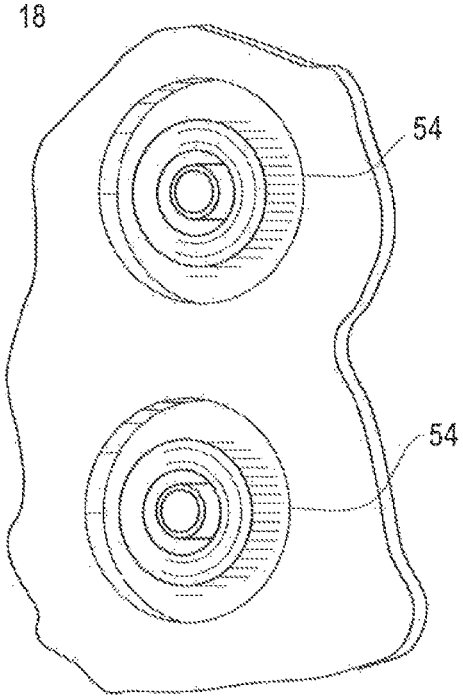
FIG. 2
54
54

SPA WITH TEMPERATURE RESPONSIVE PUMP ACTIVATION AND DEACTIVATION INDEPENDENT OF HEATER ACTIVATION

FIELD OF THE INVENTION

The invention concerns a spa having (1) an electronic data processing system electronically coupled to a heater and a pump which turns the pump on and off independent of the heater being on and off responsive to a temperature differential; (2) the pump is downstream of and in fluid line connection with the heater; (3) a fluid line which injects water mixed with ozone into a filter assembly; and (4) an air intake which recirculates air from a sealed cavity when the spa is covered.

BACKGROUND

U.S. Pat. No. 8,406,932, Hollaway discloses the use of a single temperature sensor in the body of the heater to monitor water flow conditions through the heater and to also measure water temperature in the spa. Water flow rates are estimated by the amount of time it takes for the heater to change from one temperature to another, with the pump running normally. The rate of change is, therefore, more important than the actual temperatures. Each time the pump and heater are activated due to an apparent need for heat, based on the water temperature inside the heater, or the length of time since the last heat cycle, the pump will be turned on long enough to compare the real water temperature with the estimated water temperature. Any difference will be recorded and applied as an offset to the next activation. New offset errors will recorded with future activations, adapting the process to changes in ambient conditions.

BRIEF DESCRIPTION OF THE DRAWINGS

FIG. 1 is an isometric view of a spa embodying features of the present invention; certain features of the spa, both external and internal, have been intentionally omitted.

FIG. 2 is a blowup view of the hydrotherapy jets indicated in FIG. 1.

DETAILED DESCRIPTION

Figure 3:
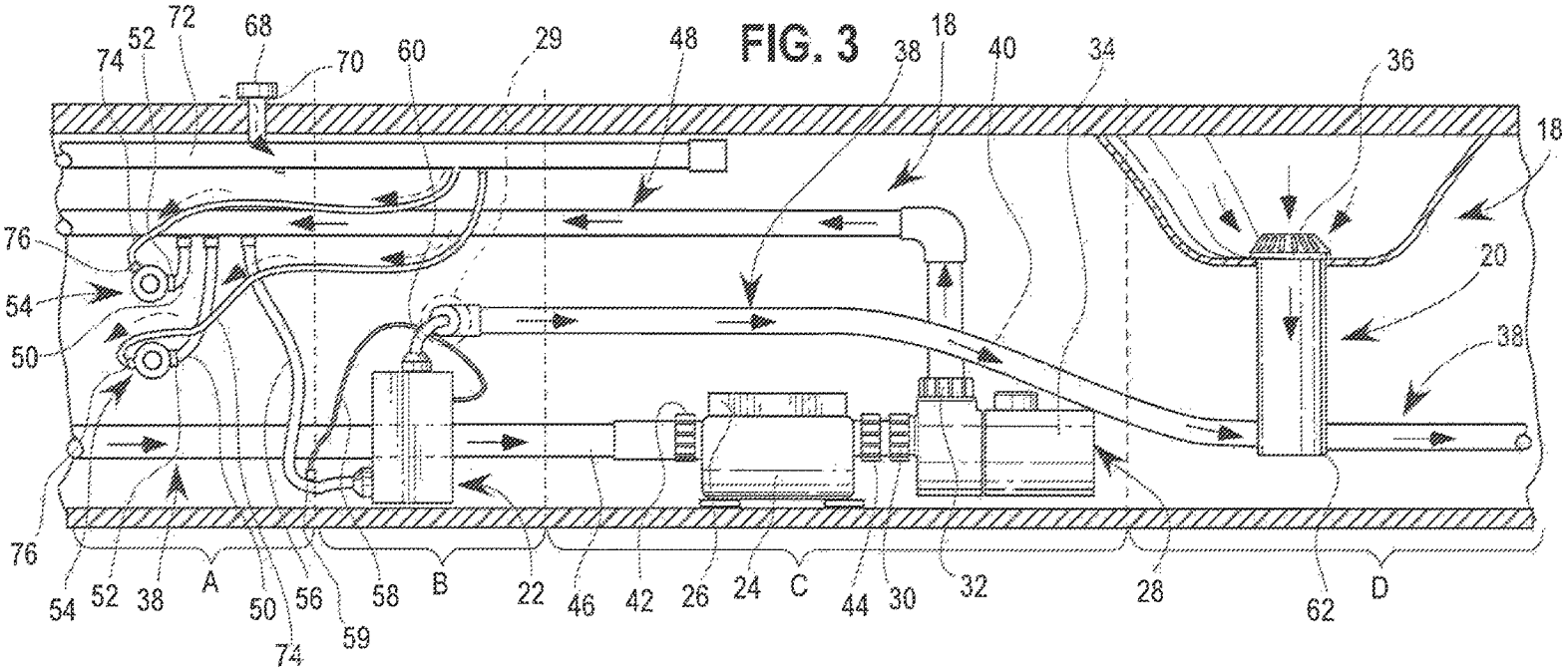
FIG. 3 is a simplified non-proportional schematic view of the internal workings of the spa of FIG. 1; the quadrants A, B, C and D of the schematic generally correspond to the quadrants A, B, C and D of FIG. 1.
Figure 4:
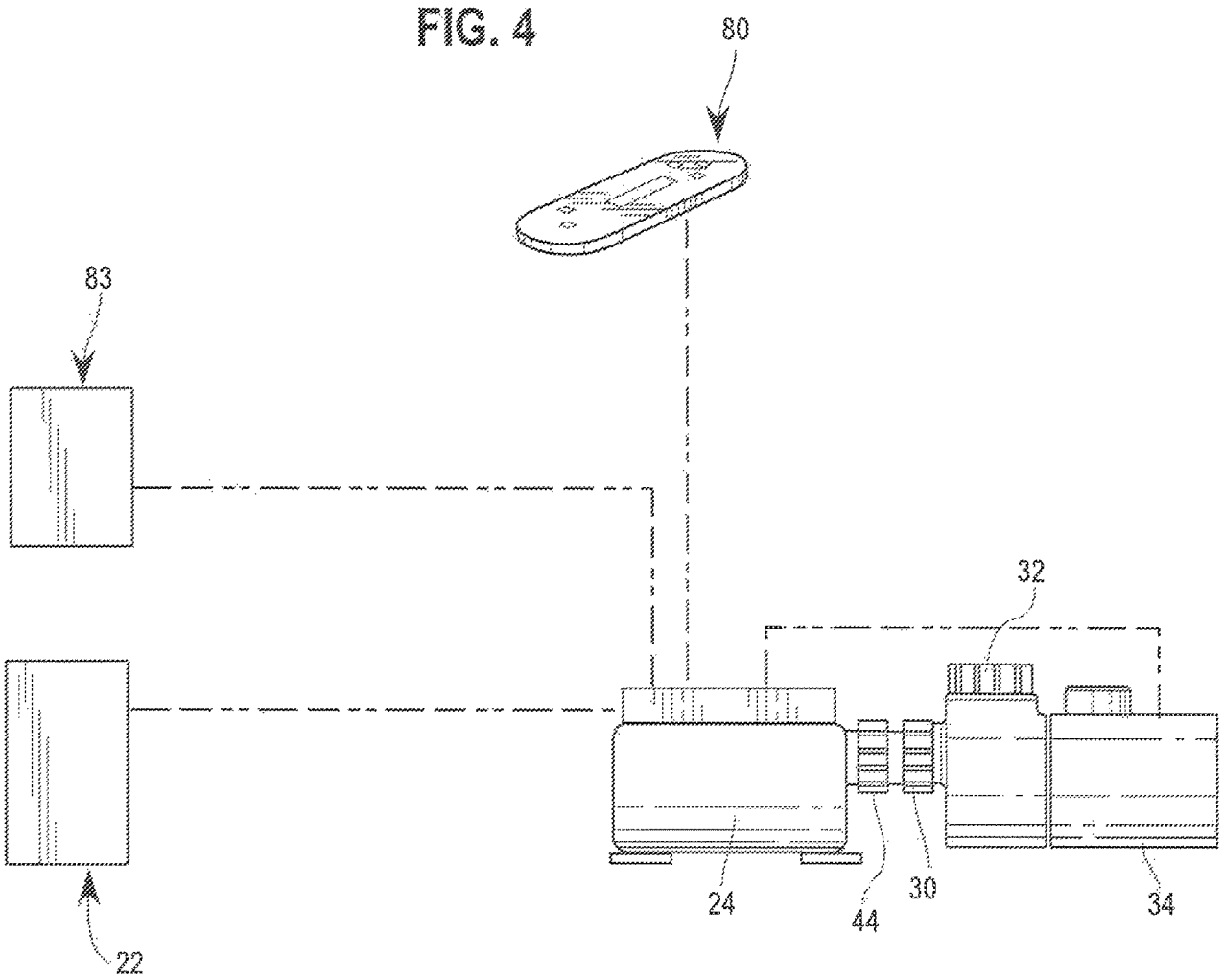
FIG. 4 is a simplified non-proportional schematic showing the electronic data processing system coupled to the control panel, temperature sensor, ozonizor/ultraviolet light assembly, heater and pump of the spa.
Figure 5:
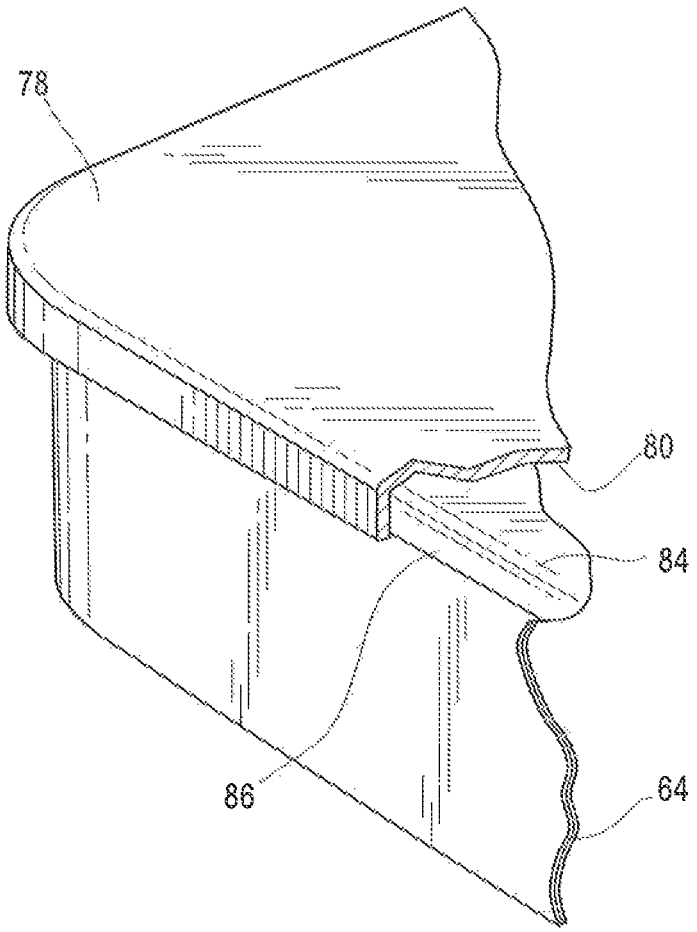
FIG. 5 is a simplified partial cut away view of the spa showing how the spa cover seals with the shoulder and rim of the spa shell.
Figure 6:
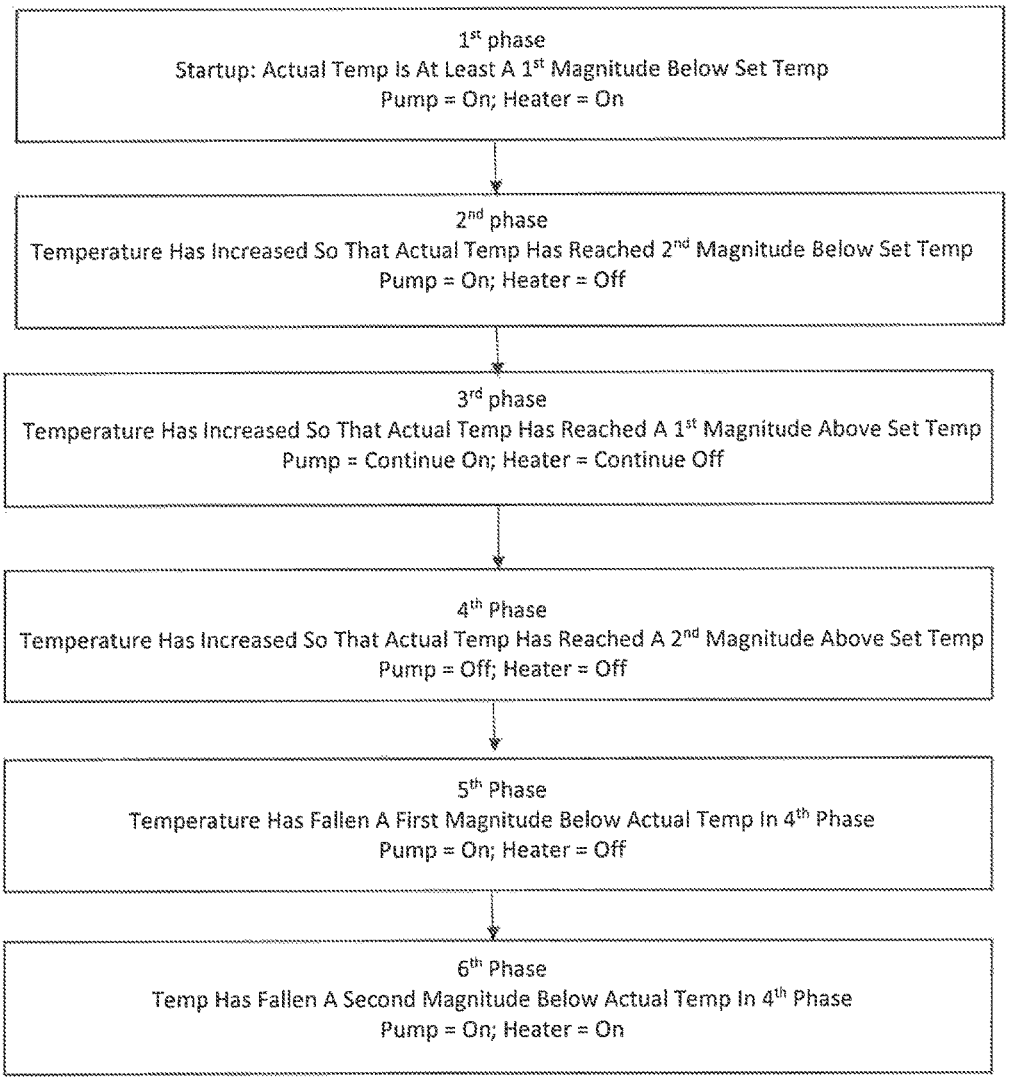
FIG. 6 is a flow chart outlining how the electronic data processor of the spa controls the heater and pump to take advantage of the radiant heat of the pump.

A spa/hot tub has a cabinet 10. Housed in the cabinet is a shell 12. The shell provides the water holding, and person receiving cavity. The term water does not mean pure water but a liquid that comprises water or is water based. Between an interior facing surface 14 of the cabinet and exterior facing surface 16 of the shell is a void space 18. Housed in the void space is a filter assembly 20, ultraviolet light/ozonizor assembly 22, heater 24, electronic data processing system 26, and primary pump 28. Of course other components are in the void space such as fluid connection lines. An item herein described in fluid line connection is connected by a fluid line. The fluid line can comprise one or more tubes, pipes, couplers, connectors, or components and combinations thereof.

Downstream of and in fluid line connection with the filter assembly 20 is the heater 24. The heater is a water heater and in this particular embodiment is a coil element type heater.

The primary pump 28 comprises a pump inlet 30, pump outlet 32, and a motor 34. The pump is a liquid pump. The liquid preferably is water. The pump inlet is downstream of and in fluid line connection with the filter assembly 20 and heater 24. The heater 24 is at the suction side, pump inlet 30, of the pump 28. Water is received from the water heater 24 to the pump 28 through the pump inlet 30.

A water circulation intake 29, opening through the shell, is upstream of the filter assembly 20, heater 24, and pump 28. The intake 29 is in fluid line connection with the filter assembly, heater and pump. The water intake 29 preferably opens through a lower portion of the shell opposite the shell open end. The intake is towards the floor of the shell. The water intake 29 provides for an amount of water to be drawn first through the filter assembly 20 from the intake 29, than from the filter assembly to pass through the heater 24 and from the heater 24 to pass through the pump 28. Another amount of water is drawn into the filter assembly from the skimmer opening 36. The water drawn through the skimmer 36, passes from the skimmer 36 through the filter assembly 20, than from the filter assembly to the heater and from the heater 24 to the pump 28.

Water is drawn into the water intake 29; along a fluid path 38 from the intake, the water passes into the filter assembly 20 through a fluid line 40 such as a pipe, tube, connector, coupler or component or combinations thereof; from the filter assembly 20 water passes into the heater 24, along the fluid path 38, through the heater inlet 42. From the heater, water passes along the fluid path 38 into the pump 28 through the pump inlet 30 at the suction side of the pump 28. Water passes out of the heater through the heater outlet 44.

A fluid line has a length measured from a place 46 upstream of the heater, to the pump inlet 30, of at least 30% and preferably 50% of the longest end to end length of the shell. The fluid line connection is substantially straight between, excepting the workings of the heater, the place 46 to the pump inlet.

Water received by the pump inlet 30 is pumped out of the pump 28 through the pump outlet 32 at the pressure side of the pump. The water from the outlet enters a primary fluid line 48. The primary fluid line has secondary fluid lines 50 branching off the primary line 48. The secondary lines preferably branch off at a manifold of the primary fluid line 48. The secondary fluid lines 50 connect to water inlets 52 of hydrotherapy jets 54.

Some of the water discharged from the pump outlet 32 into the primary fluid line 48 is diverted by a fluid diversion line 56. The diversion line 56 comprises one or more tubes, pipes, connectors, couplers or components or combinations thereof. Water in the diversion line is ozonized by ozone carried from the ozonizor/ultra violet light assembly 22 along a tube 58. Ozone enters the diversion line 56 from the ozone tube 58 through a venturi inlet 59. Water in the diversion line 56 is thus mixed with ozone. The water mixed with ozone in the diversion line 56 passes into the oznonizor/ultra violet light assembly 22 and is radiated with ultraviolet light. The radiated ozone mixed with water is carried away from the ozonizor by a fluid line 60. The fluid line 60 connects to the fluid line 40 which carries water from the intake 29 to the filter assembly. The radiated ozone is thus carried to the filter assembly along line 40. The diversion line is in fluid connection with the filter assembly. There is thus a pathway which carries water mixed with ozone away from the pump outlet to and into the filter assembly. The water enters the filter assembly through the same path as water from the intake 29. In this example, the ozone is radiated with ultraviolet light. The ozonized water could be received by the filter assembly without being radiated by ultra violet light.

In an area in the filter assembly, water drawn into the filter assembly from the skimmer 36 and water ozonized with radiated ozone are mixed. The mixing helps clean the water. All water entering the filter assembly exits the filter assembly at the filter outlet 62. From the outlet the water is carried along the fluid path 38 to the heater 24. The water exits the heater at the heater outlet 44 and from the heater outlet enters the pump 28 at the suction side through the pump inlet 30.

The interior surface 14 of the cabinet has an added layer of insulation 64. The cabinet is without radiant heat vents. The cabinet is ventless. The exterior surface of the shell which faces the interior surface of the cabinet is uninsulated. The shell is itself uninsulated. The insulation arrangement and ventless cabinet allows the spa to take advantage of radiant heat generated by the pump. The spa uses an electronic data processing system 26, to ensure the spa takes advantage of the radiant heat. The processing system includes programming on a medium and circuitry, which includes microprocessor circuitry. The processing system, electronically coupled to the heater and pump, runs the heater and pump independently responsive to the magnitude of a temperature differential between a set temperature and the actual temperature of an operating amount of water carried by the shell.

In more detail, the spa has a running mode wherein the actual temperature of the operating amount of water in a first operating phase of the spa is at a first magnitude in degree below a set temperature. The set temperature is the desired temperature set by the operator or user for the water. Preferably the magnitude is more than one degree. The spa has just been activated to be turned on from the off position. The user turns the spa on and off and sets the temperature at a control panel 80 housed in a rim of the shell. The control panel is connected to the electronic data processing system. The processing system responsive to the first magnitude difference in temperature between the set temperature and actual temperature turns the heater on and the pump on so the pump and heater are both running. In the first phase a signal from the water temperature sensor 83 connected to the processing system is sent to circuitry of the processing system. The microprocessor circuitry of the processing system based on the signal of the actual water temperature determines if the difference between the actual water temperature and set temperature is the first magnitude. The set temperature is stored in circuitry of the processing system. If the difference between the actual temperature and set temperature is the first magnitude, the microprocessor circuitry in the processing system sends a signal to turn the heater on and to turn the pump on.

The spa has a second phase which succeeds the first phase. In the second phase the actual temperature is a second magnitude in degree below the set temperature. The second magnitude is less than the first magnitude. The second magnitude is preferably less than one degree. In this phase, responsive to the actual temperature being a second magnitude of degree below the set temperature, the processing system continues to allow the pump to be on and running. Responsive to the actual temperature being the second magnitude below the set temperature, the heater is turned off. If the spa were just turned on and the temperature was in the second magnitude than the pump would be turned on and the heater would not be turned on. It would remain off. In the second phase, a signal from the water temperature sensor 83 connected to the processing system is sent to circuitry of the processing system. The microprocessor circuitry of the processing system based on the signal of the actual water temperature determines if the difference between the actual water temperature and set temperature is the second magnitude. If the difference between the actual temperature and set temperature is the second magnitude, the microprocessor circuitry in the processing system sends a signal to turn the heater off and the circuitry allows the pump to be on and running. If the spa were just turned on and the temperature was in the second magnitude than the pump would be turned on and the heater would not be turned on. It would remain off.

The spa has a third phase which succeeds the second phase. In the third phase the actual temperature is a first magnitude in degree above the set temperature. Responsive to the actual temperature being a first magnitude in degree above the set temperature, the processing system continues to have the heater turned off and continues to allow the pump to run. The first magnitude is preferably less than one degree. If the spa were just turned on and the temperature was in the first magnitude above than the pump would be turned on and the heater would not be turned on. It would remain off. In the third phase, a signal from the water temperature sensor 83 connected to the processing system is sent to circuitry of the processing system. The microprocessor circuitry of the processing system based on the signal of the actual water temperature determines if the difference between the actual water temperature and set temperature is the first magnitude above the set temperature. If the difference between the actual temperature and set temperature is the first magnitude, the microprocessor circuitry in the processing system continues to have the heater off and the circuitry allows the pump to be on and running. If the spa were just turned on and the temperature was in the first magnitude above than the pump would be turned on and the heater would not be turned on. It would remain off.

The spa has a fourth phase which succeeds the third phase. In the fourth phase the actual temperature is a second magnitude in degree greater than the set temperature. The second magnitude is greater than the first magnitude of the third phase. In the fourth phase, the processing system responsive to the actual temperature being a second magnitude in degree above the set temperature, turns the pump off and continues to have the heater in the off mode. The second magnitude is preferably one degree. If the spa were just turned on and the temperature was in the second magnitude above than the pump would not be turned on and the heater would not be turned on. Both would remain off. In the fourth phase, a signal from the water temperature sensor connected to the processing system is sent to circuitry of the processing system. The microprocessor circuitry of the processing system based on the signal of the actual water temperature determines if the difference between the actual water temperature and set temperature is the second magnitude above the set temperature. If the difference between the actual temperature and set temperature is the second magnitude, the microprocessor circuitry in the processing system continues to have the heater off and the circuitry turns the pump off. If the spa were just turned on and the temperature was in the second magnitude above, than the pump would not be turned on and the heater would not be turned on. Both would remain off.

The spa has a fifth phase which succeeds the fourth phase. In the fifth phase the actual temperature has fallen a first magnitude in degree below the actual temperature of the fourth phase. Preferably the actual temperature has fallen below, but less than two degrees below the set temperature, or the actual temperature is at the set temperature. The processing system responsive to the temperature falling a first magnitude in degree below the actual temperature of the fourth phase and below or to the set temperature turns the pump on and continues to allow the heater to be off. In the fifth phase, a signal from the water temperature sensor connected to the processing system is sent to circuitry of the processing system. The microprocessor circuitry of the processing system, based on the signal of the actual water temperature determines if the difference between the actual water temperature and set temperature is the first magnitude below the actual temperature of the fourth phase and preferably the actual temperature has fallen below, but less than two degrees below the set temperature, or the actual temperature is at the set temperature. If the difference between the actual temperature and set temperature is the first magnitude below, the microprocessor circuitry in the processing system continues to have the heater off and the circuitry turns the pump on.

The spa has a sixth phase which succeeds the fifth phase. In the sixth phase the actual temperature has fallen a second magnitude in degree below the actual temperature of the fourth phase. The second magnitude is greater than the first magnitude of the fifth phase. The second magnitude is preferably more than one degree and more preferably at least two degrees below the set temperature. In the sixth phase the processing system responsive to the temperature falling a second magnitude in degree below the actual temperature of the fourth phase and preferably at least a certain degree below the set temperature (preferably two degrees below the set temperature), turns the heater on and has turned the pump on or continues the pump to be on and operate in the running mode. In the sixth phase, a signal from the water temperature sensor connected to the processing system is sent to circuitry of the processing system. The microprocessor circuitry of the processing system based on the signal of the actual water temperature determines if the difference between the actual water temperature and set temperature is the second magnitude below the actual temperature of the fourth phase and is preferably more than one degree and more preferably at least two degrees below the set temperature. If the difference between the actual temperature and set temperature is the second magnitude below, the microprocessor circuitry in the processing system turns the heater on and the circuitry turns the pump on or continues to have it run in the on position.

The term magnitude as used in the above discussion of phases 1-6 comprises a predetermined amount.

The spa has an air intake 68. The air intake 68 opens through the shell. The air intake has an outlet that opens into an air tube 72. The intake has an inlet which is open to the environment external to the void space and shell. When the pump is running and the air intake is in the open position, air is drawn in through the intake inlet 70 and discharged from the intake outlet into air tube 72. From the air tube 72, smaller air tubes 74 branch off. The air travels in these tubes 74 into air inlets 76 of the hydrotherapy jets 54. Water exiting the hydrotherapy jets 54 provide for the venturi effect to draw the air from the intake 68 into the air inlets 76.

When the spa is covered with the spa cover 78, the intake 68 is open, and the pump is running, air is drawn into the air intake inlet 70 from a sealed cavity 90 between the interior surface 80 of the spa cover and the water surface 82 in the water cavity and an internal surface of the shell. The spa cover provides a fluid tight seal against air from entering the sealed cavity and into the intake from outside the sealed cavity. The spa cover interior, shell shoulder 84, and shell skirt 86 provide the fluid tight seal. The seal is a contact seal. The spa cover is in sealing engagement with a rim of the spa. To obtain the seal, the cover is pleatless. The cover is made with careful precision. In this covered operating mode, the air from the sealed cavity enters the air intake 68, then enters the air tube 72, then passes through the smaller tubes 74 and then into the air inlet 76 of the jet 54. The air is thus discharged into the water and back into the sealed cavity 90 and re-circulated. Providing the sealed cavity thus provides for a closed loop or circuit to circulate air through the air intake. The closed loop or circuit has advantages. It ensures no pressure build up between (1) the cover and water surface and (2) the cover and interior shell surface. Pressure build up would cause heat mixed with air to be released from under the cover to the outside. Having the air intake in a sealed cavity also ensures radiant heat in the void space is used to heat the water as opposed to being cooled by air external to the cavity and void space. It also ensures outside air external to the cavity and void space does not enter the water.

The other above features have advantages over previous spa assemblies. Passing ozonized water from the pump into the filter assembly ensures a higher degree of ozonization of the water compared to previous systems which pass ozone from the ozonizor into the water in the water cavity without passing the water mixed with ozone into the filter. Passing the ozonized water into the filter ensures the ozone gas is used for cleaning as opposed to simply being bubbled out of the water. Bubbling ozone gas out of the water in an excessive amount stains the interior of the spa cover.

In other systems, the heater is at the pressure side of the pump assembly and receives water from the pump outlet. This arrangement provides for unwanted cavitation in the pump and unwanted air blocks. The herein described arrangement lessens cavitation and air blocks.

Other spa assemblies do not turn the pump on and off responsive to the magnitude of temperature differential in degree between the actual temperature and the set temperature. The pump, in these other assemblies, is turned on and off responsive to when the heater is supposed to be on and responsive to when a user sets the pump to run to filter the water. Indeed in these systems the radiant heat of the pump is vented outside the cabinet. Applicant's system does not allow the user to turn the pump on and off to filter the water with a filtration run cycle. The user simply turns the spa on and sets the temperature. The pump is run to adjust the water to the appropriate temperature. It is surprisingly understood running the spa at the appropriate temperature achieves proper filtration of the water.

It is to be understood that the invention is not limited in its application to the details of construction and arrangement of components set forth in the description or as illustrated in the drawings. The invention is capable of other embodiments and of being practiced or being carried out in various ways. Also, it is to be understood that the phraseology and terminology used herein is used for the purpose of description and should not be regarded as limiting. The use of "including", "comprising" or "having" and variations thereof is meant to encompass the items listed thereafter and equivalence thereof as well as additional items. Unless specified or limited otherwise, the terms "mounted", "connected", "supported," and "coupled" and variations thereof are used broadly and encompass both direct and indirect mountings, connections, supports and couplings.

The invention claimed is:

1. A spa comprising:

a cabinet;

an uninsulated shell disposed in said cabinet;

a water intake opening through said shell;

a filter assembly downstream of and in fluid line connection with said water intake;

a heater down stream of and in fluid line connection with said filter assembly;

a pump in fluid line connection with said heater;

a hydrotherapy jet in fluid line connection with said pump;

a diversion line in fluid line connection with said pump;

an assembly comprising an ozonizor, said ozonizor in fluid communication with said diversion line;

said filter assembly coupled to said diversion line;

an air intake opening through the shell, said air intake opens into an air tube, said air tube in fluid line connection with said hydrotherapy jet, said air intake has an inlet which opens to an environment external to a void space and shell;

a data processing system coupled to the heater, pump, a control panel and a temperature sensor, wherein the data processing system responsive to when the actual temperature of an amount of water in the shell is a magnitude in degrees below a set temperature 1) turns the heater off if it is on or does not turn the heater on if it is already off and 2) turns the pump on if it is off or if it is already running does not turn the pump off.

2. The spa of claim 1 wherein the filter assembly has a water inlet which receives ozonized water from a fluid line, said fluid line coupled to said assembly comprising said oznonizor by way of a fluid line carrying ozonized water away from said assembly.

3. The spa of claim 2 wherein the diversion line includes a venturi inlet in fluid communication with the ozonizor.

4. The spa of claim 1 wherein the electronic data processing system responsive to when the actual temperature of water in the shell is a magnitude in degrees above a set temperature 1) turns the heater off if it is on or does not turn the heater on if it is already off and 2) turns the pump on if it is off or if it is already running does not turn the pump off.

5. The spa of claim 1 wherein the electronic data processing system responsive to when the actual temperature of water in the shell has fallen a magnitude in degrees below a previous actual temperature, said previous actual temperature above a set temperature 1) does not turn the heater on when it is in the off mode and 2) turns the pump on when it is in the off mode.

6. The spa of claim 1 wherein when the pump is running and the air intake is in an open position, an air path is formed where air is drawn in through the air intake inlet and discharged from the intake into a venturi inlet of the hydrotherapy jet.

7. The spa of claim 6 wherein when the spa is covered with a spa cover, the air drawn into the air intake inlet is from a sealed cavity between an interior surface of the spa cover and a water surface in the shell and an internal inward facing surface of the shell.

8. The spa of claim 7 wherein the spa cover provides a fluid tight seal against air from entering the sealed cavity and into the intake from outside the sealed cavity.

9. A spa comprising:

a cabinet;

an uninsulated shell disposed in said cabinet;

a water intake opening through said shell;

a filter assembly downstream of and in fluid line connection with said water intake;

a heater down stream of and in fluid line connection with said filter assembly;

a pump in fluid line connection with said heater;

a hydrotherapy jet in fluid line connection with said pump;

a diversion line in fluid line connection with said pump;

an assembly comprising an ozonizor, said ozonizor in fluid communication with said diversion line;

said filter assembly coupled to said diversion line;

an air intake opening through the shell, said air intake opens into an air tube, said air tube in fluid line connection with said hydrotherapy jet, said air intake has an inlet which opens to an environment external to a void space and shell;

a data processing system coupled to the heater, pump, a control panel and a temperature sensor, wherein the data processing system responsive to when the actual temperature of an amount of water in the shell is less than one degree Farenheit below a set temperature 1) turns the heater off if it is on or does not turn the heater on if it is already off and 2) turns the pump on if it is off or if it is already running does not turn the pump off.

10. The spa of claim 9 wherein the filter assembly has a water inlet which receives ozonized water from a fluid line, said fluid line coupled to said assembly comprising said oznonizor by way of a fluid line carrying ozonized water away from said assembly.

11. The spa of claim 10 wherein the diversion line includes a venturi inlet in fluid communication with the ozonizor.

12. The spa of claim 9 wherein the electronic data processing system responsive to when the actual temperature of water in the shell is less than one degree Fahrenheit above a set temperature 1) turns the heater off if it is on or does not turn the heater on if it is already off and 2) turns the pump on if it is off or if it is already running does not turn the pump off.

13. The spa of claim 9 wherein the electronic data processing system responsive to when the actual temperature of water in the shell has fallen less than two degrees Fahrenheit below a previous actual temperature, said previous actual temperature above a set temperature 1) does not turn the heater on when it is in the off mode and 2) turns the pump on when it is in the off mode.

14. The spa of claim 9 wherein when the pump is running and the air intake is in an open position, an air path is formed where air is drawn in through the air intake inlet and discharged from the intake into a venturi inlet of the hydrotherapy jet.

15. The spa of claim 14 wherein when the spa is covered with a spa cover, the air drawn into the air intake inlet is from a sealed cavity between an interior surface of the spa cover and a water surface in the shell and an internal inward facing surface of the shell.

16. The spa of claim 15 wherein the spa cover provides a fluid tight seal against air from entering the sealed cavity and into the intake from outside the sealed cavity.

17. An assembly of a spa for regulating the temperature of water carried in a shell of the spa comprising:

a data processing system coupled to a heater of the spa, a pump of the spa, a control panel of the spa and a temperature sensor of the spa, wherein the data processing system responsive to when the actual temperature of an amount of water in the shell is less than one degree Fahrenheit below a set temperature 1) turns the heater off if it is on or does not turn the heater on if it is already off and 2) turns the pump on if it is off or if it is already running does not turn the pump off, and wherein the electronic data processing system responsive to when the actual temperature of water in the shell is less than one degree Fahrenheit above a set temperature 1) turns the heater off if it is on or does not turn the heater on if it is already off and 2) turns the pump on if it is off or if it is already running does not turn the pump off.

18. The spa of claim 17 wherein the electronic data processing system responsive to when the actual temperature of water in the shell has fallen less than two degrees Fahrenheit below a previous actual temperature, said previous actual temperature above a set temperature 1) does not turn the heater on when it is in the off mode and 2) turns the pump on when it is in the off mode.

* * * * *